US009454108B2

(12) United States Patent
Katagiri et al.

(10) Patent No.: US 9,454,108 B2
(45) Date of Patent: Sep. 27, 2016

(54) IMAGE FORMING APPARATUS

(71) Applicant: CANON KABUSHIKI KAISHA, Tokyo (JP)

(72) Inventors: Shinji Katagiri, Yokohama (JP); Shuichi Tetsuno, Kawasaki (JP); Masaru Ohno, Ebina (JP); Masaru Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/822,263

(22) Filed: Aug. 10, 2015

(65) Prior Publication Data

US 2016/0048096 A1 Feb. 18, 2016

(30) Foreign Application Priority Data

Aug. 14, 2014 (JP) ..... 2014-165260

(51) Int. Cl.
*G03G 15/16* (2006.01)
*G03G 15/01* (2006.01)
*G03G 15/02* (2006.01)

(52) U.S. Cl.
CPC ..... *G03G 15/1665* (2013.01); *G03G 15/0189* (2013.01); *G03G 15/161* (2013.01); *G03G 15/0266* (2013.01); *G03G 15/1675* (2013.01)

(58) Field of Classification Search
CPC ..... G03G 15/1665
USPC ..... 399/66
See application file for complete search history.

(56) References Cited

U.S. PATENT DOCUMENTS

| | | | |
|---|---|---|---|
| 9,002,227 | B2 | 4/2015 | Ohno et al. |
| 9,058,010 | B2 | 6/2015 | Ito et al. |
| 2014/0161494 | A1 | 6/2014 | Ishizumi et al. |
| 2015/0016833 | A1 | 1/2015 | Nakaegawa et al. |
| 2015/0153703 | A1 | 6/2015 | Ohno et al. |

FOREIGN PATENT DOCUMENTS

| | | | |
|---|---|---|---|
| JP | 2012-098709 | A | 5/2012 |
| JP | 2013-231958 | A | 11/2013 |
| JP | 2014-106475 | A | 6/2014 |
| JP | 2014-115339 | A | 6/2014 |

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

In an image forming apparatus that performs primary transfer by allowing a current to flow to an intermediate transfer belt in the circumferential direction of the belt, the image forming apparatus has a control unit that can execute a second mode in which a second current amount which is larger than a first current amount is supplied from a current supply unit to an intermediate transfer belt and a toner image is primarily transferred only from a first photosensitive body to the intermediate transfer belt. The control unit can adjust surface potentials of the first photosensitive body and a second photosensitive body, and makes the absolute value of the surface potential of the second photosensitive body less than the absolute value of the surface potential of the first photosensitive body when the second mode is executed.

14 Claims, 11 Drawing Sheets

IMAGE FORMING APPARATUS

BACKGROUND OF THE INVENTION

1. Field of the Invention

The present invention relates to a color image forming apparatus using an electrophotography process or the like.

2. Description of the Related Art

An image forming apparatus configured to use an intermediate transfer member, such as a copier and a laser beam printer, is known. In such an image forming apparatus, in a primary transfer step, a toner image formed on the surface of a photosensitive drum serving as an image bearing member is transferred onto the intermediate transfer member by applying a voltage by a voltage source to a primary transfer member disposed opposite the photosensitive drum. In a full color printer in which a color image constituted by a plurality of colors is formed, a toner image constituted by a plurality of colors is formed on the intermediate transfer member surface by executing this primary transfer step with respect to each color and overlapping the toner images of the respective colors. In a secondary transfer step, a toner image of a plurality of colors which is formed on the intermediate transfer member surface is transferred onto the surface of a recording material such as paper by applying a voltage to the secondary transfer member. A color image is then formed by permanently fixing the transferred toner image to the recording material by a fixing means.

Japanese Patent Application Laid-open No. 2012-98709 discloses a configuration in which primary transfer is performed by using a belt-shaped member (referred to hereinbelow as "intermediate transfer belt") as the intermediate transfer member and applying a voltage to a current supply member that is in contact with an outer circumferential surface of the intermediate transfer belt at a position which is set apart from the primary transfer region. In such a configuration, the primary transfer of a toner image from the photosensitive drum surface to the intermediate transfer belt is performed in image forming stations by using a secondary transfer member as the current supply member and allowing a current to flow from the current supply member to the intermediate transfer belt in the circumferential direction of the belt. Such a configuration makes it possible to remove a high-voltage power supply dedicated to the primary transfer from the apparatus configuration and reduce the cost and size of the image forming apparatus.

However, in the abovementioned configuration, in a monochromatic mode in which only a black station is used, a primary transfer current still flows in the photosensitive drums of color stations which are not used. As a result, the primary transfer current in the black station can be insufficient. Since the primary transfer is performed by allowing the secondary transfer current to flow in the belt circumferential direction on the intermediate transfer belt with respect to the photosensitive drum, a voltage cannot be switched independently for each image station. Thus, in the monochromatic mode in which a current flows also in the color stations which are not used, it is difficult to allow a suitable primary transfer current to flow in the photosensitive drum of the black station.

SUMMARY OF THE INVENTION

It is an objective of the present invention to provide an image forming apparatus that performs primary transfer by allowing a current to flow to an intermediate transfer belt in the circumferential direction of the belt, the apparatus being capable of ensuring good primary transferability.

In order to attain the abovementioned objective, the image forming apparatus in accordance with the present invention, comprises:

a first photosensitive body that bears a toner image;

a second photosensitive body that bears a toner image;

a movable intermediate transfer belt;

a current supply unit that is in contact with the intermediate transfer belt in a movement direction of the intermediate transfer belt at a position different from the positions where the first photosensitive body and the second photosensitive body are in contact with the intermediate transfer belt, and that supplies an electric current to the intermediate transfer belt; and a control unit that can execute a first mode in which a first current amount is supplied from the current supply unit to the intermediate transfer belt and a toner image is primarily transferred from the first photosensitive body and the second photosensitive body to the intermediate transfer belt, and a second mode in which a second current amount which is less than the first current amount is supplied from the current supply unit to the intermediate transfer belt and the toner image is primarily transferred only from the first photosensitive body to the intermediate transfer belt, wherein the control unit can adjust surface potentials of the first photosensitive body and the second photosensitive body, and makes an absolute value of the surface potential of the second photosensitive body less than an absolute value of the surface potential of the first photosensitive body when the second mode is executed.

Further features of the present invention will become apparent from the following description of exemplary embodiments (with reference to the attached drawings).

DESCRIPTION OF THE EMBODIMENTS

Modes for carrying out the invention will be explained hereinbelow in greater detail on the basis of examples thereof with reference to the drawings. The dimensions, materials, shapes, mutual arrangements and the like of the constituent components described in the embodiments should be changed according to the configuration of the apparatus to which the invention is applied, and various conditions. Thus, the scope of the invention is not intended to be limited to the below-described embodiments.

(Embodiment 1)

[General Configuration of Image Forming Apparatus]

Figure 1:
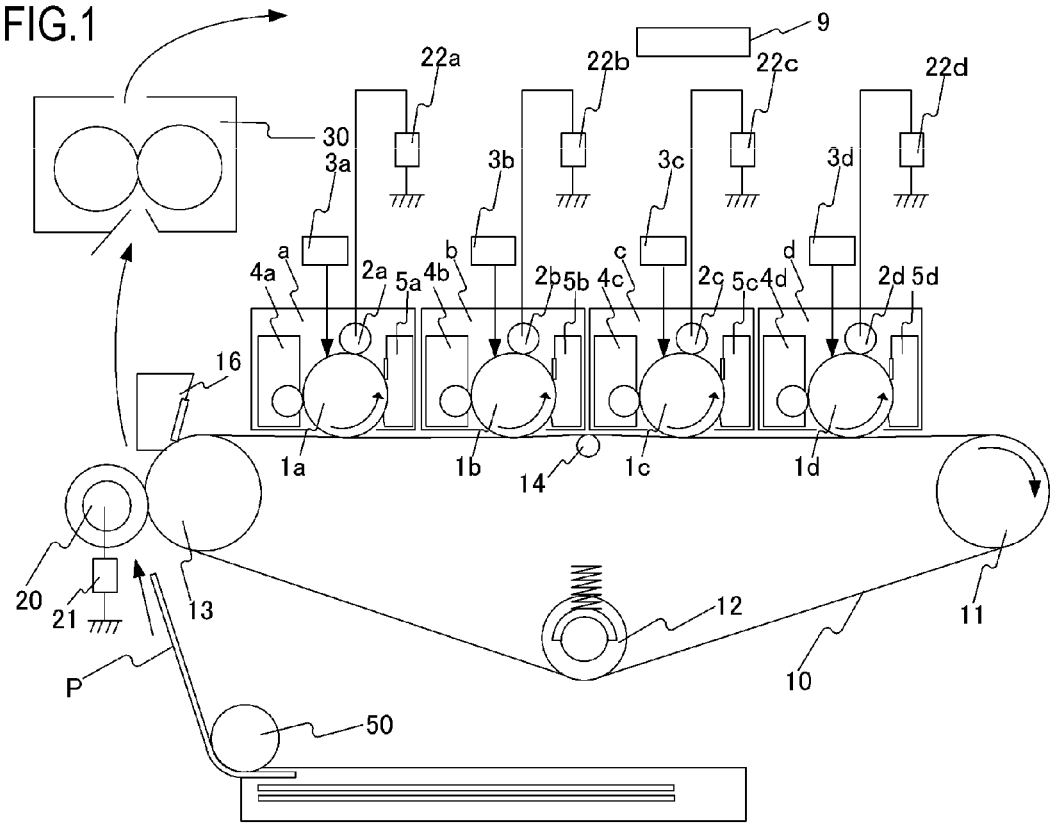
FIG. 1 is an explanatory drawing of an image forming apparatus of Embodiment 1 of the present invention.

The configuration and operation of the image forming apparatus of the present embodiment will be explained hereinbelow with reference to FIG. 1. FIG. 1 is a schematic diagram illustrating an example (laser color printer) of the image forming apparatus according to the present embodiment. The image forming apparatus according to the present embodiment is a printer of the so-called tandem type which is provided with four image forming stations (a) to (d). The first image forming station (a) forms a yellow (Y) color image, the second image forming station (b) forms a magenta (M) color image, the third image forming station (c) forms a cyan (C) color image, and the fourth image forming station (d) forms a black (Bk) color image. The image forming stations have the same configuration, except for the color of the toner accommodated therein, and the explanation hereinbelow is performed using the first image forming station (a).

The first image forming station (a) is provided with a drum-shaped electrophotographic photosensitive member (referred to hereinbelow as "photosensitive drum") 1*a*, a charging roller 2*a* which is a charging member, a developing device 4*a*, and a cleaning device 5*a*. The photosensitive drum la is an image bearing member that is rotationally driven at a predetermined circumferential speed (process speed) in the direction shown by an arrow and bears a toner image. The developing device 4*a* serves for developing a yellow toner at the photosensitive drum 1*a* accommodating the yellow toner. The cleaning device 5*a* serves for recovering the toner that has adhered to the photosensitive drum 1*a*. In the present embodiment, the cleaning device 5*a* is provided with a cleaning blade which is a cleaning member that is in contact with the photosensitive drum 1*a*, and a waste toner box which accommodates the toner recovered by the cleaning blade.

A CPU (control unit) 9 which is a control IC of the image forming apparatus including a controller or the like starts an image forming operation upon receiving an image signal and rotationally drives the photosensitive drum 1*a*. The photosensitive drum 1*a* is subjected to uniform charging treatment to a predetermined potential at a predetermined polarity (negative polarity in the present embodiment) by the charging roller 2*a* in the rotation process and subjected to exposure corresponding to the image signal by an exposure means 3*a*. As a result, a latent electrostatic image corresponding to the yellow color component image of the target color image is formed. Then, this latent electrostatic image is developed by the developing device (yellow developing device) 4*a* at the development position and visualized as a yellow toner image. In this case, the normal charging polarity of the toner accommodated in the developing device is a negative polarity. In the present embodiment, the latent electrostatic image is inversely developed by the toner charged to the same polarity as the electrostatic polarity of the photosensitive drum by the charging member, but the present invention can be also used in an electrophotographic device in which a latent electrostatic image is normally developed by a toner charged to a polarity inverted with respect to the charging polarity of the photosensitive drum.

An intermediate transfer belt 10 is tensioned (supported) by a plurality of rollers 11, 12, 13, which serve as tension members (support members), and rotationally driven at a circumferential speed substantially equal to that of the photosensitive drum 1*a* in the direction matching the movement direction of the photosensitive drum 1*a* by a contact region which is in contact with the photosensitive drum 1*a*. The yellow toner image formed on the photosensitive drum 1*a* is transferred (primary transfer) onto the intermediate transfer belt 10 in the process of passing through the contact region (referred to hereinbelow as "primary transfer region") of the photosensitive drum 1*a* and the intermediate transfer belt 10. In the present embodiment at the time of primary transfer, an electric current flows in the circumferential direction of the intermediate transfer belt 10 from a secondary transfer roller 20 serving as a current supply member that is in contact with the intermediate transfer belt 10, and a primary transfer potential is formed in each primary transfer region of the intermediate transfer belt 10. A method for forming the primary transfer potential in the present embodiment is explained hereinbelow. A primarily untransferred toner remaining on the surface of the photosensitive drum 1*a* is cleaned and removed with the cleaning device 5*a* and then supplied to an image forming process performed after charging.

Likewise, a magenta toner image of the second color, a cyan toner image of the third color, and a black toner image of the fourth color are formed by the second, third, and fourth image forming stations (b), (c), and (d) and successively transferred in an overlapping manner onto the intermediate transfer belt 10. As a result, a composite color image corresponding to the target color image is formed on the intermediate transfer belt 10. The four-color toner image on the intermediate transfer belt 10 is entirely transferred (secondarily transferred) to the surface of a recording material P such as paper which is supplied by a paper supply means 50 as the four-color toner image passes through a secondary transfer region formed by the intermediate transfer belt 10 and the secondary transfer roller 20 serving as a secondary transfer member. The recording material P bearing the four-color toner image is introduced into a fixing unit 30 where the toners of four colors are melted, mixed, and fixed to the recording material P by heating and pressurization. The toner remaining on the intermediate transfer belt 10 after the secondary transfer is cleaned and removed with a cleaning device 16. The above-described operations result in the formation of a full-color printed image.

[Configuration of Primary Transfer Region]

Figure 2A:
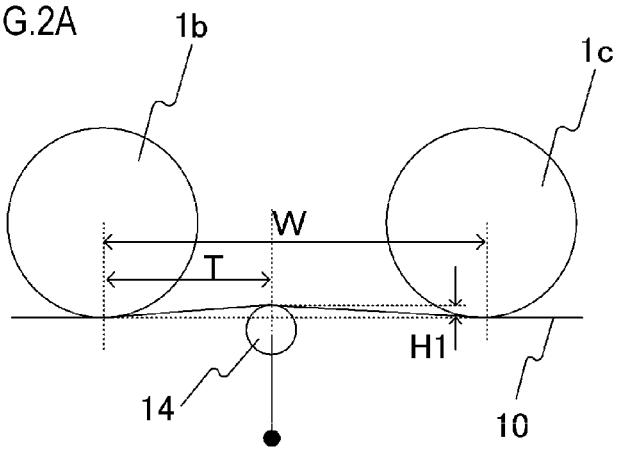
FIGS. 2A and 2B are a set of explanatory drawings of the configuration of a primary transfer region in Embodiment 1 of the present invention.
Figure 2B:
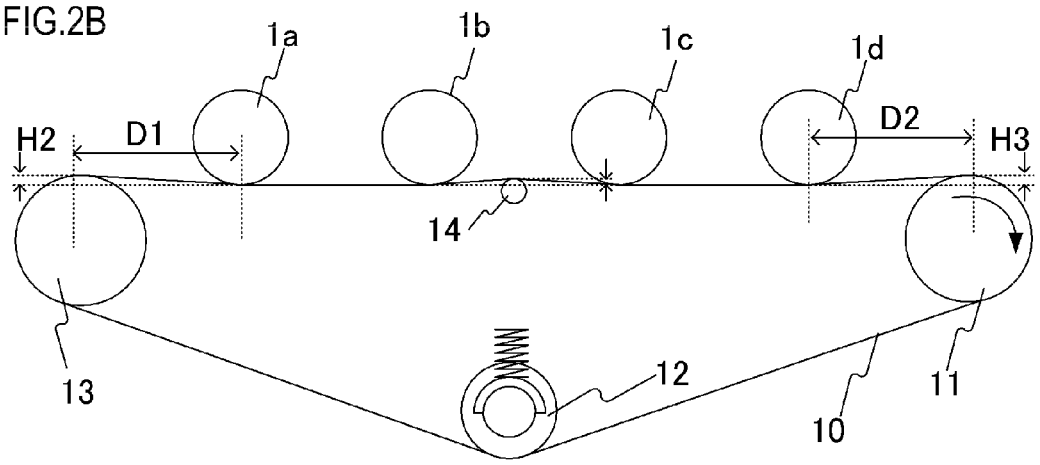

The intermediate transfer belt 10, the rollers 11, 12, 13 serving as tension members, and the metal roller 14 which are necessary for forming a primary transfer potential in each primary transfer region will be explained hereinbelow with reference to FIGS. 2A and 2B. FIGS. 2A and 2B are a set of schematic diagrams illustrating the configuration of the primary transfer region in Embodiment 1 of the present invention. FIG. 2A illustrates the arrangement of the metal roller 14, and FIG. 2B illustrates the entire configuration of the primary transfer region.

As depicted in FIG. 2B, the intermediate transfer belt 10 serving as the intermediate transfer member is disposed at a position facing the image forming stations (a), (b), (c), (d). The intermediate transfer belt 10 is an endless belt imparted with electric conductivity by adding an electrically conductive agent to a resin material. The belt is tensioned in three axes of a driver roller 11, a tension roller 12, and a secondary transfer opposing roller 13 which are tension members. The tensioning is performed by the tension roller 12 under a total tension force of 60 N. The intermediate transfer belt 10 is rotationally driven at a circumferential speed substantially equal to that of the photosensitive drums 1*a*, 1*b*, 1*c*, 1*d* by the driver roller 11, which is rotated by a drive source (not shown in the figure), in the direction (forward direction) matching the movement direction in the contact region in which the intermediate transfer belt is in contact with the photosensitive drums 1*a*, 1*b*, 1*c*, 1*d*. In the present embodiment a primary transfer surface (the surface denoted by M in the figure) onto which the toner image is primarily transferred by the photosensitive drums 1*a*, 1*b*, 1*c*, 1*d*, this surface being the outer circumferential surface of the intermediate transfer belt 10, is formed by two tension members, namely, the secondary transfer opposing roller 13 and the driver roller 11.

As depicted in FIG. 2A, the metal roller 14 which is a contact member that is in contact with the inner circumferential surface of the intermediate transfer belt 10 is disposed at a position between the photosensitive drum 1*b* and the photosensitive drum 1*c* in the movement direction (rotation direction) of the intermediate transfer belt 10. The two end portions of the metal roller 14 are held at a frame (not shown in the figure) of the apparatus body at positions lifted with respect to the horizontal surface formed by the photosensitive drums 1*b*, 1*c* and the intermediate transfer belt 10 between the second image forming station (b) and the third image forming station (c). Thus, the position of the region where the metal roller 14 is in contact with the intermediate transfer belt 10 with respect to the intermediate transfer belt 10 which extend horizontally is arranged such as to be above the regions where the photosensitive drums 1*b*, 1*c* are in contact with the intermediate transfer belt 10. As a result, tension is generated between the regions of the intermediate transfer belt 10 which are in contact with the photosensitive drums 1*b*, 1*c*, and the winding amount of the intermediate transfer belt 10 upon the photosensitive drums 1*b*, 1*c* can be ensured.

The metal roller 14 is constituted by a nickel-plated SUS round rod of a straight shape with an outer diameter of 6 mm and rotates following the rotation of the intermediate transfer belt 10. The metal roller 14 comes into contact over a predetermined area in the longitudinal direction which is perpendicular to the movement direction of the intermediate transfer belt 10. The distance between the photosensitive drum 1*b* of the second image forming station (b) and the photosensitive drum 1*c* of the third image forming station (c) is denoted by W, the distance between the photosensitive drum 1*b* and the metal roller 14 is denoted by T, and the lift height of the metal roller 14 with respect to the intermediate transfer belt 10 is denoted by H1. The distance, as referred to herein, is a distance between the adjacent axial centers in the movement direction of the intermediate transfer belt 10. In the present embodiment W=50 mm, T=25 mm, and H1=2 mm.

Further, as depicted in FIG. 2B, in order to ensure the winding amount of the intermediate transfer belt 10 on the photosensitive drums 1*a*, 1*d*, the driver roller 11 and the secondary transfer opposing roller 13 are also lifted above the horizontal surface formed by the photosensitive drums 1*a* to 1*d* and the intermediate transfer belt 10. The effect of ensuring the winding amount of the intermediate transfer belt 10 on the photosensitive drums 1*a*, 1*d* is that transfer defects generated due to unstable contact between the photosensitive drums 1*a*, 1*d* and the intermediate transfer belt 10 are suppressed. The distance between the secondary transfer opposing roller 13 and the photosensitive drum 1*a* is denoted by D1, the distance between the driver roller 11 and the photosensitive drum 1*d* is denoted by D2, the lift height of the secondary transfer opposing roller 13 with respect to the intermediate transfer belt 10 is denoted by H2, and the lift height of the driver roller 11 is denoted by H3. In the present embodiment, D1=D2=50 mm, and H2=H3=2 mm. The above-mentioned secondary transfer opposing roller 13, driver roller 11, and metal roller 14 are in an electrically floating state and are not grounded.

The intermediate transfer belt 10 which is used in the present embodiment uses an endless polyimide resin mixed with carbon as an electrically conductive agent and has a circumferential length of 700 mm and a thickness of 90 μm. In the present embodiment, the polyimide resin is used as a material for the intermediate transfer belt 10, but any other material may be used, provided it is a thermoplastic resin. For example, materials such as polyesters, polycarbonates, polyacrylates, acrylonitrile-butadiene-styrene copolymers (ABS), polyphenylene sulfides (PPS), and polyvinylidene fluoride (PVdF), and mixed resins thereof may be used. Further, fine electrically conductive metal oxide particles and ionic conducting agents can be used as the electrically conductive agent instead of carbon.

The intermediate transfer belt 10 of the present embodiment has a volume resistivity of $1\times10^{9}$ Ω·cm. The volume resistivity is measured using a ring probe type UR (system MCP-HTP12) in Hiresta-UP (MCP-HT450) manufactured by Mitsubishi Chemicals Co., Ltd. As for the measurement conditions, the indoor temperature is set to 23° C., the indoor temperature is set to 50%, the applied voltage is 100 V, and the measurement time is 10 sec. In the present embodiment, the intermediate transfer belt 10 with a volume resistivity within a range of $1\times10^{7}$ to $1\times10^{10}$ Ω·cm can be used. The volume resistivity used herein is a measure of electric conductivity of the material of the intermediate transfer belt 10, and the value of resistance in the circumferential direction is important when determining whether or not the desired primary transfer potential can be actually formed by allowing an electric current to flow in the circumferential direction.

Figure 3A:
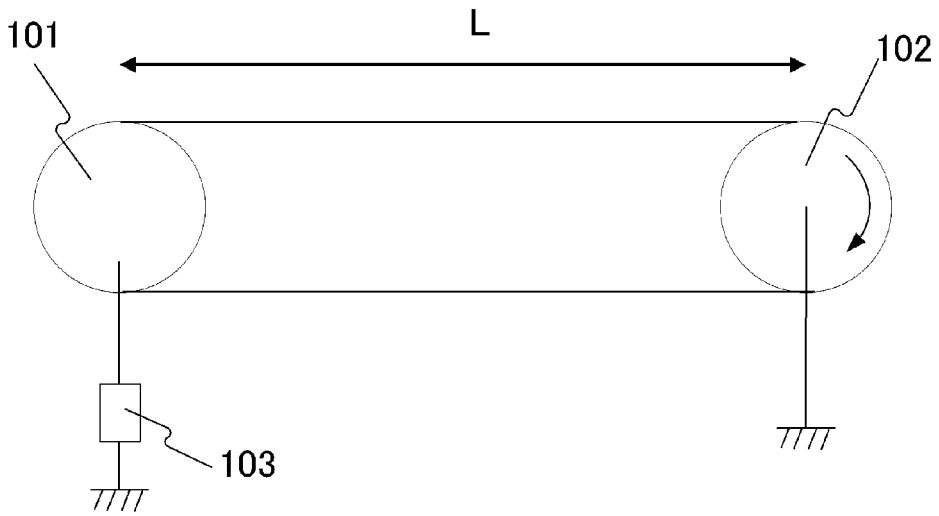
FIGS. 3A and 3B are a set of diagrams representing a system for measuring the resistance of the intermediate transfer belt in the circumferential direction in Embodiment 1 of the present invention.
Figure 3B:
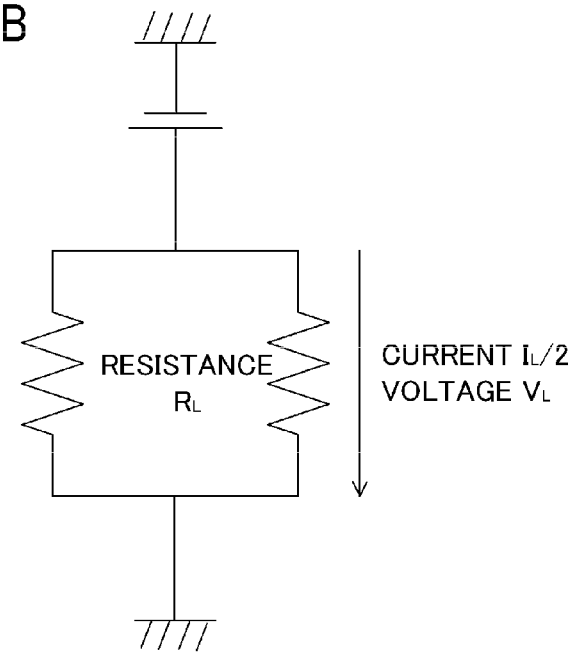

FIGS. 3A and 3B are a set of schematic diagram illustrating a system for measuring the resistance of the intermediate transfer belt 10 in the circumferential direction in Embodiment 1 of the present invention. The resistance of the intermediate transfer belt 10 in the circumferential direction was measured using a jig for measuring the resistance in circumferential direction which is depicted in FIG. 3A. Initially, the apparatus configuration will be explained. The intermediate transfer belt 10 which is to be measured is tensioned without a slack by an inner surface roller 101 and a driver roller 102. The inner surface roller 101 which is made from a metal is connected to a high-voltage power supply (high-voltage power supply manufactured by TREK, Model_610E) 103, and the driver roller 102 is grounded. The surface of the driver roller 102 is coated with a conductive rubber which has a resistance sufficiently lower than that of the intermediate transfer belt 10, and the intermediate transfer belt 10 is rotated at a speed of 100 mm/sec.

The measurement method is explained hereinbelow. In a state in which the intermediate transfer belt 10 is rotated by the driver roller 102 at a speed of 100 mm/sec, a constant current $I_L$ is applied to the inner surface roller 101 and voltage $V_L$ is monitored with the high-voltage power supply 103 connected to the inner surface roller 101. The measurement system depicted in FIG. 3A can be considered as an equivalent circuit depicted in FIG. 3B. In such a case, the resistance $R_L$ in the circumferential direction of the intermediate transfer belt 10 over the distance L (300 mm in the present embodiment) between the inner surface roller 101 and the driver roller 102 can be calculated by the expression $R_L=2V_L/I_L$. The resistance in the circumferential direction is determined by recalculating the $R_L$ for the circumferential length of the intermediate transfer belt 10 equivalent to 100 mm. In order to allow an electric current to flow from the current supply member to the photosensitive drum 1 through the intermediate transfer belt 10, it is preferred that the resistance in the circumferential direction be equal to or less than $1\times10^9$ Ω.

In the configuration according to the present embodiment, the intermediate transfer belt 10 is used that has a resistance value of $1\times10^6$ Ω in the circumferential direction which has been determined by the above-described measurement method. The measurements with respect to the intermediate transfer belt 10 of the present embodiment were conducted at a constant current of $I_L$=5 μA, and the monitor voltage $V_L$ at this time was 3.25 V. The monitor voltage $V_L$ is determined within an interval of one rotation of the intermediate transfer belt 10 from the average value of the values measured in this interval. Concerning $R_L$, since $R_L=2V_L/I_L$, $R_L=2\times3.25/(5\times10^{-6})=1.5\times10^6$ Ω, and where this value is recalculated for an equivalent of 100 mm, the resistance value in the circumferential direction becomes $0.5\times10^6$ Ω. In the present embodiment, a conductive belt in which the electric current can thus be allowed to flow in the circumferential direction is used as the intermediate transfer belt 10.

[Method for Forming Primary Transfer Potential]

In the configuration according to the present embodiment, the secondary transfer power supply 21 that applies a voltage as a transfer power supply to the secondary transfer member is also used as a power supply for performing the primary transfer. Thus, the secondary transfer power supply 21 is a transfer power supply that supplies an electric current to the primary transfer region of the secondary transfer roller 20 and the intermediate transfer belt 10, this power supply being used commonly for the primary transfer and the secondary transfer. The secondary transfer roller 20 is a current supply member in the present embodiment.

As described hereinabove, the primary transfer is performed by allowing a current to flow from the secondary transfer power supply 21 to the photosensitive drums 1*a* to 1*d* through the secondary transfer roller 20 and in the belt circumferential direction of the intermediate transfer belt 10. At his time, a primary transfer potential is formed in the image forming stations (a), (b), (c), (d), and the toner on the photosensitive drums 1*a* to 1*d* moves on the intermediate transfer belt 10 under the effect of the difference between the primary transfer potential and the photosensitive drum potential, thereby performing the primary transfer.

The configuration of the secondary transfer region in the present embodiment is explained hereinbelow. The secondary transfer roller 20 serving as a secondary transfer member in the secondary transfer region has an outer diameter of 18 mm and is obtained by coating a nickel-plated steel rod with an outer diameter of 8 mm with a foamed spongy body having a volume resistance of $10^8$ Ω·cm and a thickness of 5 mm and including an NBR and an epichlorohydrin rubber as the main components. Further, the secondary transfer roller 20 is brought into contact with the outer circumferential surface of the intermediate transfer belt 10 by a pressurizing force of 50 N and forms the secondary transfer region. The secondary transfer roll 20 is rotationally driven with respect to the intermediate transfer belt 10 and configured such that a constant electric current is supplied from the transfer power supply 21 when the toner located on the intermediate transfer belt 10 is secondarily transferred onto the recording material P such as paper.

The transfer power supply 21 is configured to be connected to the secondary transfer roller 20 and supply a secondary transfer voltage outputted from a transformer (not shown in the figure) to the secondary transfer roller 20. The CPU 9 which is the control IC of the image forming apparatus controls the secondary transfer voltage supplied by the transfer power supply 21 by performing feedback of a difference between a preset control current and a monitor current which is an actual output value, such that the secondary transfer current becomes substantially constant. The transfer power supply 21 can output a voltage within a range of 100 V to 4000 V.

Figure 4:
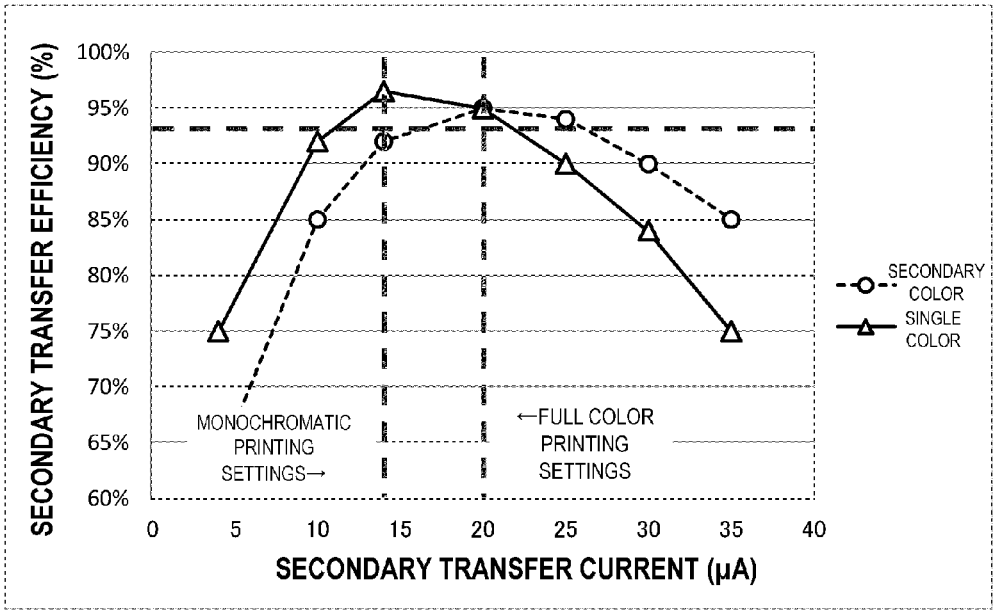
FIG. 4 illustrates the relationship between a secondary transfer current and a secondary transfer efficiency in Embodiment 1 of the present invention.

FIG. 4 is a graph showing the difference in secondary transfer efficiency caused by the difference in image pattern. In the graph, the transfer efficiency is plotted against the ordinate and the secondary transfer current is plotted against the abscissa. The value of the transfer efficiency on the ordinate is calculated on the basis of the result obtained by measuring the concentration of secondarily untransferred toner with a Macbeth concentration meter (produced by Gretag Macbeth Inc.), and a low value indicates a degraded transfer efficiency. A solid line in the graph represents the transfer efficiency in monochromatic printing, and a broken line represents the transfer efficiency in the case of overlapping two colors such as red, green, and blue (secondary colors).

The CPU 9 can execute a full-color mode in which a toner image is primarily transferred from the photosensitive drums 1*a*, 1*b*, 1*c*, 1*d* of all of the stations to the intermediate transfer belt 10, and a monochromatic mode in which a toner image is primarily transferred from the photosensitive drum 1*d* which is a photosensitive drum of a specific station to the intermediate transfer belt 10. In this case, the specific photosensitive drum 1*d* is taken as a first photosensitive member, and other photosensitive drums 1*a*, 1*b*, 1*c* are taken as second photosensitive members.

The value of the secondary transfer current in the present embodiment is set to 20 μA according to the transfer efficiency of the secondary colors in the full color mode and to 14 μA according to the monochromatic transfer efficiency (in order to form only a monochromatic image) in the monochromatic mode.

Further, in the configuration of the present embodiment, the intermediate transfer belt 10 and the photosensitive drums 1*a*, 1*b*, 1*c* of the color stations are not separated from each other in the monochromatic mode to reduce cost and dimensions. In other words, in the monochromatic mode, the photosensitive drums 1*a*, 1*b*, 1*c* of the color stations are also brought into contact with the intermediate transfer belt 10, together with the photosensitive drum 1*d* of the black station (d).

[Features of Potential Control Method in the Present Embodiment]

The specific feature of the present embodiment is that in the monochromatic mode (during single transfer), the absolute value of the charging voltage of the photosensitive drums 1*a*, 1*b*, 1*c* of the color image forming stations (a), (b), (c) which are not used is lowered with respect to that of the photosensitive drum 1*d* of the black station (d) which is used. As a result, the absolute value of the charging potential of the photosensitive drums 1*a*, 1*b*, 1*c* (second photosensitive members) is reduced with respect to that of the charging potential of the photosensitive drum 1*d* (first photosensitive member). Explained hereinbelow is the case in which the comparison in the relationship of negative polarities is performed by the absolute values.

In the present embodiment, the charging rollers 2*a* to 2*d* are obtained by coating a nickel-plated steel rod with an outer diameter of 6 mm with a nitrile butadiene rubber (NBR) with a thickness of 3 mm as an elastic layer and then coating a polyurethane resin with a thickness of 10 μm as a surface layer. The volume resistivity of the elastic layer is adjusted to $10^{-4}$ Ω·cm and the volume resistivity of the surface layer is adjusted to $10^{11}$ Ω·cm. The charging roller 2*a* is brought into contact with the photosensitive drum 1*a* by a pressurizing force of 6 N and is rotationally driven with respect to the photosensitive drum 1*a*. A DC voltage is applied by the charging high-voltage power supplies 22*a*, 22*b*, 22*c*, 22*d* to the charging rollers 2*a* to 2*d*. The configuration that charges the photosensitive drums corresponds to the charging device in accordance with the present invention.

In the full color mode (multiple transfer), the charging voltage (charging bias) supplied by the charging high-voltage power supplies 22*a* to 22*d* to the charging rollers 2*a* to 2*d* is controlled such that the charging voltage of all of the charging rollers 2*a* to 2*d* becomes −1000 V. As a result, the charging potential (surface potential) formed on the surface of each photosensitive drum 1*a* to 1*d* is −500 V.

In the monochromatic mode, a method for controlling the charging potential of the photosensitive drum differs between the black station (d) and the color image forming stations (a), (b), (c), which are image forming stations other than the black station (d). More specifically, in the black station (d), the charging voltage of the charging roller 2*d* is controlled to −1000 V which is the same as in the full color mode. Meanwhile, in the color image forming stations (a), (b), (c), the charging voltage of the charging rollers 2*a*, 2*b*, 2*c* is controlled to −800 V. As a result, the charging potential of the photosensitive drums 1*a*, 1*b*, 1*c* of the color image forming stations (a), (b), (c) is −300 V, and the charging potential of the photosensitive drum 1*d* in the black station (d) is −500 V. Thus, the charging potential of the photosensitive drums 1*a*, 1*b*, 1*c* of the color image forming stations (a), (b), (c) decreases (absolute value decreases) with respect to that of the photosensitive drum 1*d* of the black image forming station (d).

[Operations Performed by Potential Control Method in the Present Embodiment]

In the configuration of the present embodiment, the charging voltage of the color image forming stations (a), (b), (c) is decreased in the monochromatic mode to lower the surface potential of the photosensitive drums 1*a*, 1*b*, 1*c* and prevent the primary transfer current of the black stations (d) from decreasing.

Table 1 shows the current value of the current supply member, the values of the primary transfer current flowing in the image forming stations (a) to (d), and the primary transfer efficiency in each printing mode in the present embodiment and a comparative example, those results being used for comparative evaluation of the present embodiment and the comparative example. By contrast with the configuration of the present embodiment, in the configuration of the comparative example, the charging voltage control in the monochromatic mode is performed such that the charging voltage of the image forming stations (a) to (d) is controlled to −1000 V in the same manner as in the full color mode. As a result, the surface potential of each of the photosensitive drums 1*a* to 1*d* becomes −500 V. Other features are the same as in Embodiment 1.

Figure 5:
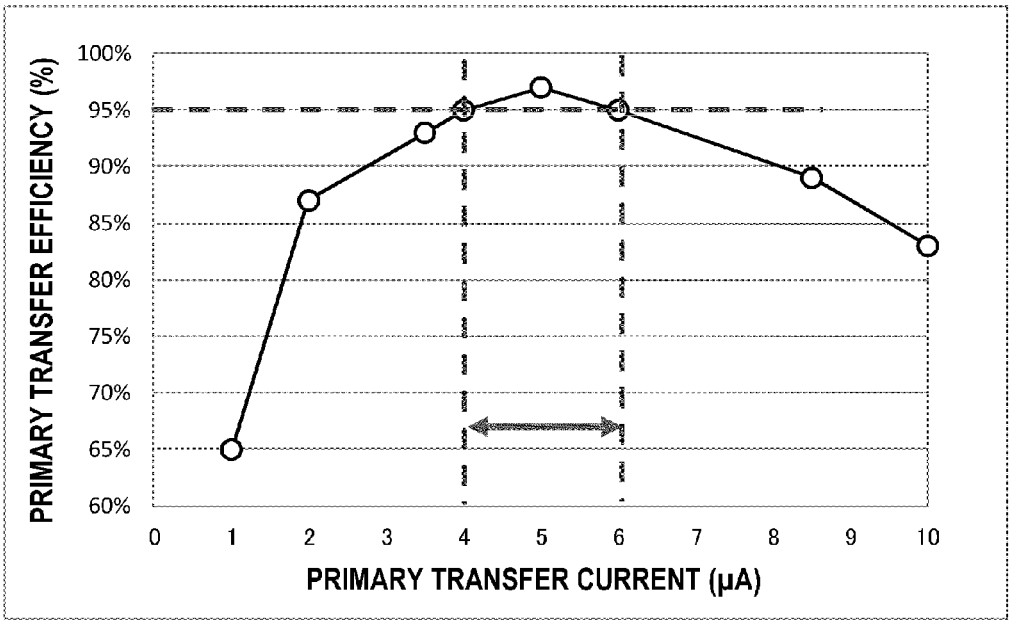
FIG. 5 illustrates the relationship between a primary transfer current and a primary transfer efficiency in Embodiment 1 of the present invention.

FIG. 5 is a graph representing the primary transfer efficiency in the configuration of the present embodiment and the comparative example. In the graph, the transfer efficiency is plotted against the ordinate, and the primary transfer current is plotted against the abscissa. The primary transfer efficiency is calculated on the basis of a result obtained by measuring the concentration of primarily untransferred toner with a Macbeth concentration meter (produced by Gretag Macbeth Inc.), and a low value indicates a degraded transfer efficiency. In the configurations of the present embodiment and the comparative example, in order to attain good primary transfer efficiency (transfer efficiency of 95% or higher), the primary transfer current should be confined to a range of 4 μA to 6 μA.

TABLE 1

| Item | Current value of current supply member | Current value of each image forming station a (Y) | b (M) | c (C) | d (Bk) | Primary transfer efficiency |
|---|---|---|---|---|---|---|
| Full color | 20 μA | 5 μA | 5 μA | 5 μA | 5 μA | 97% |
| Present embodiment (monochromatic) | 14 μA | 3 μA | 3 μA | 3 μA | 5 μA | 97% |
| Comparative example (monochromatic) | 14 μA | 3.5 μA | 3.5 μA | 3.5 μA | 3.5 μA | 93% |

Figure 6:
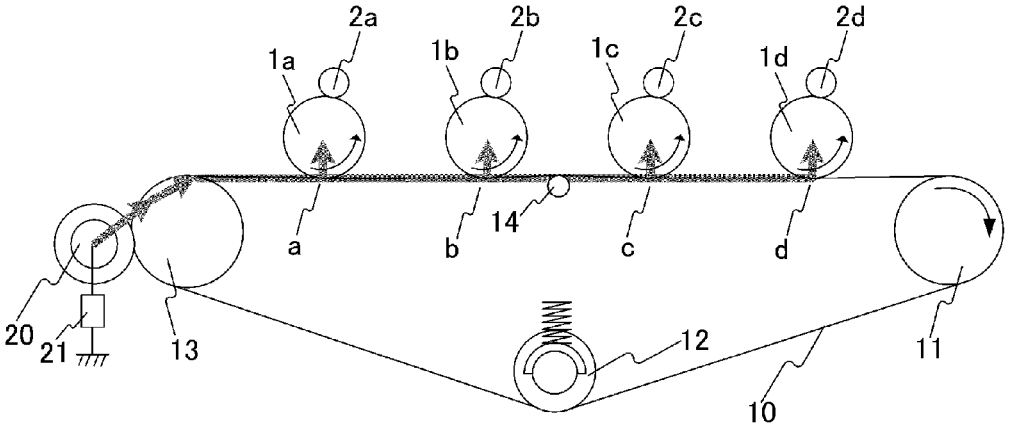
FIG. 6 is an explanatory drawing illustrating the current path in Embodiment 1 of the present invention.

The evaluation results are explained below. In the full color mode, the control is performed at a current of 20 μA from the current supply member in both the present embodiment and the comparative example. FIG. 6 depicts the current path formed when the primary transfer is performed. As depicted in FIG. 6, the electric current controlled to a constant current of 20 μA flows from the current supply member which also serves as the secondary transfer roller 20 to each image forming stations (a) to (d) along the circumferential direction on the intermediate transfer belt 10. In this case, since the resistance value in the circumferential direction of the intermediate transfer belt 10 is small and practically no voltage drop occurs therein, a primary transfer current of 5 μA flows in each primary transfer region of the image forming stations (a) to (d). As a result, good primary transferability can be ensured in each image forming station (a) to (d).

The evaluation results obtained in the monochromatic mode with the configuration of the present embodiment are explained hereinbelow. In the monochromatic mode, the current value of the current supply member is decreased from 20 μA of the full color mode to 14 μA to improve secondary transferability. Further, as mentioned hereinabove, in the configuration of the present embodiment, since the intermediate transfer belt 10 and the photosensitive drums 1*a*, 1*b*, 1*c* are not separated from each other in the monochromatic mode, the total amount of the electric current flowing in the image forming stations is also decreased. However, in the configuration of the present embodiment, the charging potential of the photosensitive drums 1*a*, 1*b*, 1*c* of the color image forming stations (a), (b), (c) is decreased to −300 V, as compared to the charging potential −500 V of the photosensitive drum 1*d* of the black station (d). As a result, the primary transfer current flowing in the color image forming stations (a), (b), (c) can be reduced to 3 μA. Therefore, the amount of primary transfer current flowing in the black station (d) can be maintained at 5 μA in the same manner as in the full color mode. As a consequence, good primary transferability can be ensured in the black station (d).

In the configuration of the comparative example, the current value of the current supply member in the monochromatic mode is also reduced to 14 μA in the same manner as in the embodiment. In this case, the charging potential of each of the photosensitive drums 1*a*, 1*b*, 1*c*, 1*d* becomes −500 V, and therefore, the image forming stations (a), (b), (c), (d) have the same primary transfer current value of 3.5 μA. As a result, since the primary transfer current value of the clack station (d) is 3.5 μA, the primary transfer efficiency decreases and transfer defects occur.

As explained hereinabove, with the configuration of the present embodiment, the charging voltage of the color image forming stations (a), (b), (c) is decreased in the monochromatic mode to lower the charging potential of the photosensitive drums 1*a*, 1*b*, 1*c*. As a result, the decrease in the primary transfer current of the black station (d) can be suppressed and, therefore, good primary transferability can be ensured.

In the configuration of the present embodiment, a method for decreasing the voltage of the charging rollers 2*a*, 2*b*, 2*c* is described as a method for lowering the charging potential of the photosensitive drums 1*a*, 1*b*, 1*c* in the monochromatic mode. Thus, a charging means is caused to function as a potential control means. However, this method for controlling the charging potential of photosensitive drums is not limiting. For example, in the monochromatic mode, the (absolute value of the) charging potential of the photosensitive drums 1*a*, 1*b*, 1*c* can be controlled to decrease by exposing the photosensitive drums 1*a*, 1*b*, 1*c* at a constant exposure amount with exposure means 3*a*, 3*b*, 3*c*. Thus, the exposure means are caused to function as a potential control means. The charging potential on the photosensitive drum which is formed by the exposure can be controlled by the intensity of exposure (laser power), and the exposure means 3*a*, 3*b*, 3*c* are controlled such as to perform the exposure with the laser light of an intensity such that the charging potential of the photosensitive drums 1*a*, 1*b*, 1*c* assumes the above-described value. This method makes it possible to obtain the same effect as that of the present embodiment. The charging potential of the photosensitive drums may be also controlled in combination with the above-described charging voltage control and exposure control.

(Embodiment 2)

The image forming apparatus according to Embodiment 2 of the present invention will be explained hereinbelow with reference to FIGS. 7 and 8. Here, mainly the features different from those of Embodiment 1 are explained, and the components same as those of Embodiment 1 are assigned with like reference numerals and the explanation thereof is herein omitted.

Figure 7:
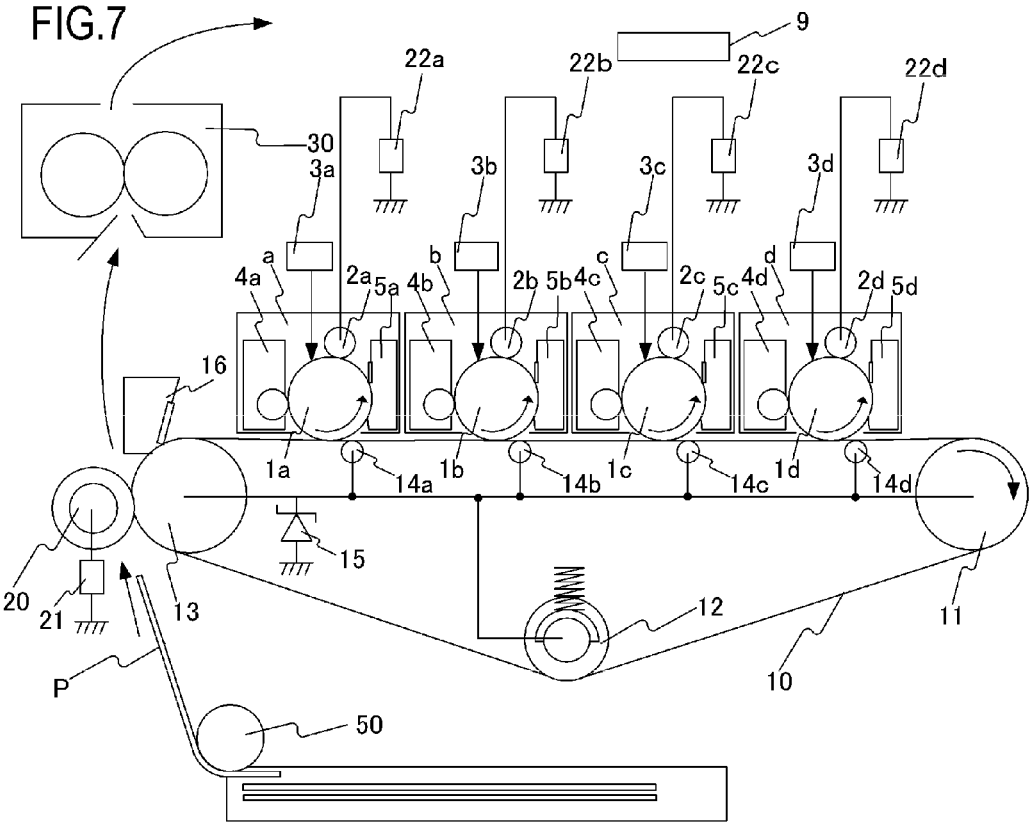
FIG. 7 is an explanatory drawing of an image forming apparatus of Embodiment 2 of the present invention.

FIG. 7 illustrates the schematic configuration of the image forming apparatus according to the present embodiment. As depicted in FIG. 7, in the configuration of the present embodiment, metal rollers 14*a*, 14*b*, 14*c*, 14*d* are disposed at positions which are offset by respective predetermined amounts from the positions corresponding to the photosensitive drums 1*a*, 1*b*, 1*c*, 1*d*, with the intermediate transfer belt 10 being interposed therebetween. The three tension rollers 11, 12, 13 that tension the intermediate transfer belt 10, and the abovementioned metal rollers 14*a*, 14*b*, 14*c*, 14*d* are grounded via a voltage maintaining element 15.

Figure 8:
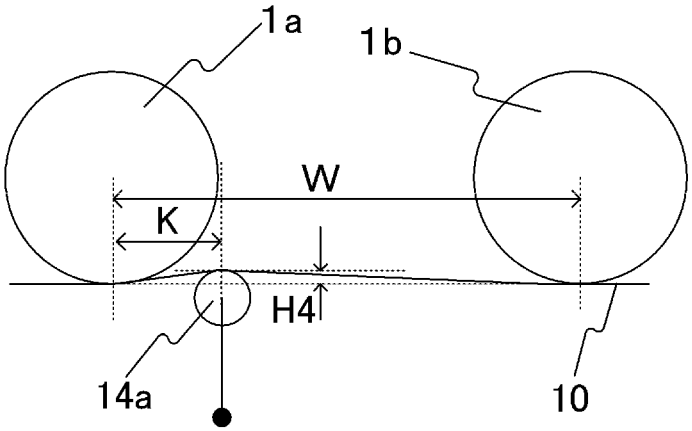
FIG. 8 is an explanatory drawing of the configuration of a primary transfer region in Embodiment 2 of the present invention.

FIG. 8 illustrates in detail the configuration of the metal rollers, and depicts, on an enlarged scale, the configuration of the first image forming station (a) in FIG. 7. In FIG. 8, the metal roller 14*a* is disposed at a position which is offset by 8 mm to the downstream side in the movement direction of the intermediate transfer belt 10 with respect to the central position of the photosensitive drum 1*a*. The roller is also arranged at a position lifted by 1 mm with respect to the horizontal surface formed by the photosensitive drum 1*a* and the intermediate transfer belt 10, so that the winding amount of the intermediate transfer belt 10 on the photosensitive drum 1*a* could be ensured. Thus, the metal roller 14*a* is disposed with respect to the intermediate transfer belt 10 extending in the horizontal direction, so that the position of the contact region of the metal roller with the intermediate transfer belt 10 is above the contact region of the photosensitive drums 1*a*, lb with the intermediate transfer belt 10.

The offset amounts of the metal rollers 14*a* to 14*d* are set such as to obtain the positions which are as close as possible in order to stabilize the intermediate transfer belt potential while avoiding any damage caused by contact of the metal rollers 14*a* to 14*d* with the photosensitive drums 1*a* to ld through the intermediate transfer belt 10. Where the distance between the photosensitive drum 1*a* and the photosensitive drum 1*b* is denoted by W, the offset distance of the metal roller 23*a* is denoted by K, and the lift height of the metal roller 23*a* with respect to the intermediate transfer belt 10 is denoted by H4, in the present embodiment, W=60 mm, K=8 mm, and H4=1 mm.

In the same manner as in Embodiment 1, the metal roller 14*a* is constituted by a nickel-plated SUS rod of a straight shape with an outer diameter of 6 mm, and this roller is rotationally driven by the rotation (movement) of the intermediate transfer belt 10. The metal roller 14*b* disposed in the second image forming station (b), the metal roller 14*c* disposed in the third image forming station (c), and the metal roller 14*d* disposed in the fourth image forming station (d) are configured similarly to the metal roller 14*a*.

In the present embodiment, the secondary transfer opposing roller 13 forming the primary transfer surface of the intermediate transfer belt 10 is grounded via the voltage maintaining element 15. The voltage maintaining element 15 serves to maintain the connected member (the secondary transfer opposing roller 13) at a predetermined potential by allowing an electric current to flow from the current supply member to the voltage maintaining element 15 through the intermediate transfer belt 10. More specifically, parts of the electric current flowing from the current supply member to contact portion with the intermediate transfer belt 10 is caused by the voltage maintaining element 15 to flow to the ground, whereby the secondary transfer opposing roller 13 is maintained at a predetermined potential. As a result, the potential of the primary transfer region is maintained at a predetermined level. The predetermined potential of the voltage maintaining element 15 is set such as to maintain a primary transfer potential which makes it possible to obtain the desired transfer efficiency in each primary transfer region. In the present embodiment, a Zener diode 15, which is a constant-voltage element, is used as the voltage maintaining element 15. The Zener diode 15 generates a predetermined voltage (referred to herein as Zener voltage) at the cathode side when a current equal to or higher than a predetermined value flows therein. In the present embodiment, the Zener voltage is set to 300 V in order to obtain the desired primary transfer efficiency.

[Method for Forming Primary Transfer Potential]

In the configuration of the present embodiment, in the same manner as in Embodiment 1, since the secondary transfer power supply 21 that applies a voltage as a transfer power supply to the secondary transfer member is used as a power supply for performing the primary transfer, the secondary transfer roller 20 serves as a current supply member in the present embodiment. As mentioned hereinabove, since the Zener diode 15 is connected to the secondary transfer opposing roller 13 on which the intermediate transfer belt 10 is tensioned, the primary transfer is performed by allowing an electric current to flow from the secondary transfer power supply 21 to the secondary transfer opposing roller 13 through the intermediate transfer belt 10. In this case, since an electric current flows in the Zener diode 15, the secondary transfer opposing roller 13 assumes a potential corresponding to the Zener diode 15. With this potential being a starting point, an electric current flows in the metal rollers 14*a* to 14*d* and a primary transfer potential is formed in the image forming stations (a) to (d). The toners of the photosensitive drums 1*a* to 1*d* are moved onto the intermediate transfer belt 10 by the difference between this primary transfer potential and the photoelectric drum potential, whereby the primary transfer is performed.

Figure 9A:
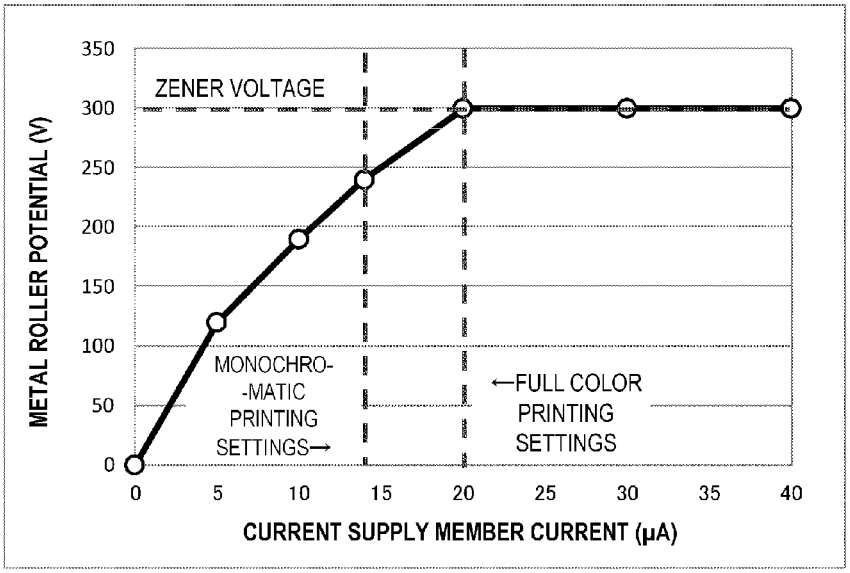
FIGS. 9A and 9B illustrate the relationship between the current of a current supply member and a metal roller potential in Embodiment 2 of the present invention.

FIG. 9A shows the relationship between the current value of the current supply member and the potential of the metal roller. In the graph, the potential of metal rollers 14*a* to 14*d* is plotted against the ordinate, and the current value of the current supply member is plotted against the abscissa. The metal roller potential rises following the increase in the current value of the current supply member, and the metal roller potential assumes a constant value of 300 V when the current exceeds 20 μA. This is because the potential of the metal rollers 14*a* to 14*d* becomes a Zener voltage as a result of the current flowing at the Zener diode 15 side. In other words, the configuration is such that the increase in potential of the metal rollers 14*a* to 14*d* can be suppressed with the Zener diode 15, and the primary transfer current is not equal to or higher than 20 μA. The present graph shows the results obtained when the potential of each of the photosensitive drums 1*a* to 1*d* is −500 V, in the same manner as in Embodiment 1, and since a current of 5 μA flows in each of the image forming stations, the total current for the four stations is 20 μA.

However, in the configuration of the comparative example, the current value of the current supply member in the monochromatic mode is reduced to 14 μA with respect to 20 μA in the full color mode to improve secondary transferability. Further, since the potential of each photosensitive drum 1*a*, 1*b*, 1*c*, 1*d* of the image forming station is −500 V, a common current of 3.5 μA flows in the image forming stations (a), (b), (c), and (d). In this case, the potential of the metal rollers 14*a*, 14*b*, 14*c*, 14*d* does not rise to the Zener voltage and becomes 240 V because no current flows to the Zener diode 15 side. As a result, since the primary transfer current value in the black station (d) becomes 3.5 μA, the primary transfer efficiency decreases and transfer defects occur.

Accordingly, the specific feature of the present embodiment is that the potential of the photosensitive drums 1*a*, 1*b*, 1*c* is decreased by setting OFF the charging voltage of the color image forming stations (a), (b), (c) in the monochromatic mode. More specifically, in the monochromatic mode, the charging voltage of the charging roller 2*d* of the black station (d) is controlled to −1000 V, that is, the same voltage as in the full color mode. Meanwhile, the charging voltage of the charging rollers 2*a*, 2*b*, 2*c* of the color image forming stations (a), (b), (c) is set OFF (no charging bias is applied). As a result, the charging potential of the photosensitive drum 1*d* of the black station (d) becomes −500 V, whereas, the charging potential of the photosensitive drums 1*a*, 1*b*, 1*c* of the color image forming stations becomes substantially 0 V, and the charging potential of the photosensitive drums 1*a*, 1*b*, 1*c* decreases.

[Operations Performed by the Potential Control Method in the Present Embodiment]

In the configuration of the present embodiment, the charging voltage of the color image forming stations (a), (b), (c) is set OFF in the monochromatic mode to lower the charging potential of the photosensitive drums 1*a*, 1*b*, 1*c* and suppress the decrease in the primary transfer current of the black station (d).

Table 2 shows the current value of the current supply member, the values of the primary transfer current flowing in the image forming stations (a) to (d), and the primary transfer efficiency in each printing mode in the present embodiment and a comparative example, those results being used for comparative evaluation of the present embodiment and the comparative example. The primary transfer efficiency is represented in the same manner as in FIG. 5 of Embodiment 1. By contrast with the configuration of the present embodiment, in the configuration of the comparative example, the charging voltage control in the monochromatic mode is performed such that the charging voltage of the image forming stations (a) to (d) is controlled to −1000 V in the same manner as in the full color mode. As a result, the charging potential of the surface of each of the photosensitive drums 1*a* to 1*d* becomes −500 V. Other features are the same as in Embodiment 2.

TABLE 2

| Item | Current value of current supply member | Current value of each image forming station | | | | Primary transfer efficiency |
|---|---|---|---|---|---|---|
| | | a (Y) | b (M) | c (C) | d (Bk) | |
| Present embodiment (monochromatic) | 14 μA | 0 μA | 0 μA | 0 μA | 5 μA | 97% |
| Comparative example (monochromatic) | 14 μA | 3.5 μA | 3.5 μA | 3.5 μA | 3.5 μA | 93% |

Figure 9B:
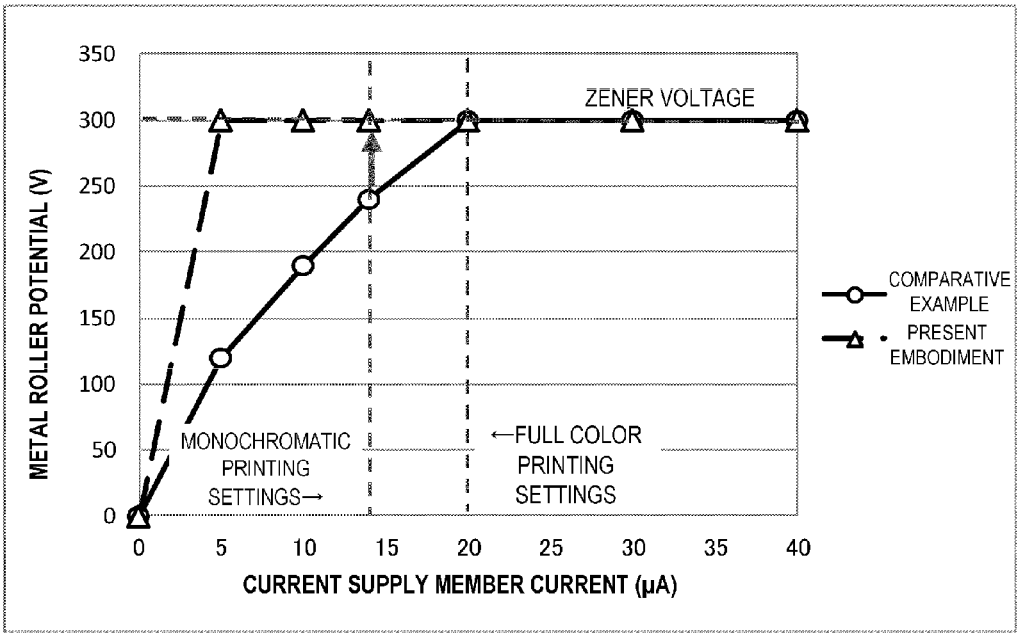

The evaluation results are explained below with reference to FIG. 9B. FIG. 9B shows the relationship between the current value of the current supply member and the potential of the metal rollers 14*a* to 14*d* in the present embodiment and comparative example.

In the configuration of the comparative example, the potential of the photosensitive drums 1*a* to 1*d* of the image forming stations is −500 V even in the monochromatic mode. Therefore, a common current of 3.5 μA flows in the image forming stations (a) to (d). In this case, the potential of the metal rollers 14*a* to 14*d* does not rise to the Zener voltage and becomes 240 V because no current flows at the Zener diode 15 side. As a result, the primary transfer current value of the black station (d) becomes 3.5 μA, which results in the decreased primary transfer efficiency and the occurrence of transfer defects.

By contrast, in the configuration of the present embodiment, the potential of the photosensitive drums 1*a*, 1*b*, 1*c* of the color image forming stations (a), (b), (c) in the monochromatic mode is substantially 0 V. Therefore, no current flows in the color image forming stations (a), (b), (c). As a result, a current flows in the Zener diode 15 and the potential of the metal rollers 14*a* to 14*d* rises to 300 V, which is the Zener voltage, thereby allowing a current of 5 μA to flow to the black station (d). At this time, a current of 9 μA flows in the Zener diode 15, this current being part of the current of 14 μA supplied from the current supply member that has not flown to the black station (d). It follows from the above, that the amount of the primary transfer current flowing in the black station (d) can be maintained at 5 μA in the same manner as in the full color mode, and good primary transferability of the black station (d) can be ensured.

As explained hereinabove, with the configuration of the present embodiment, the charging voltage of the color image forming stations (a), (b), (c) in the monochromatic mode is set OFF, thereby reducing the charging potential of the photosensitive drums 1*a*, 1*b*, 1*c* substantially to 0 V. As a result, the decrease in the primary transfer current of the black station (d) can be suppressed and, therefore, good primary transferability can be ensured.

In the configuration of the present embodiment, a method for setting OFF the charging voltage of the charging rollers 2*a*, 2*b*, 2*c* is described as a method for lowering the charging potential of the photosensitive drums 1*a*, 1*b*, 1*c* in the monochromatic mode, but this method for controlling the charging potential of photosensitive drums is not limiting. For example, in the monochromatic mode, the electrical connection of the charging rollers 2*a*, 2*b*, 2*c* and the photosensitive drums 1*a*, 1*b*, 1*c* may be released and the application of the charging voltage to the photosensitive drums 1*a*, 1*b*, 1*c* may be set OFF by separating the charging rollers 2*a*, 2*b*, 2*c*. Thus, a configuration can be realized in which the contact positions and separation positions of at least the charging rollers 2*a*, 2*b*, 2*c* with respect to the photosensitive drums 1*a*, 1*b*, 1*c* are mechanically movable. The control can be also performed to produce a charging potential difference by exposing the photosensitive drums 1*a*, 1*b*, 1*c* at a constant exposure by the exposure means 3*a*, 3*b*, 3*c*, thereby charging the charging potential of the photosensitive drums 1*a*, 1*b*, 1*c* with respect to the photosensitive drum 1*d*. The effect that can be obtained with those methods is the same as in the present embodiment. The charging potential of the photosensitive drums may be also controlled by a combination of the above-described charging voltage control and exposure control.

Figure 10:
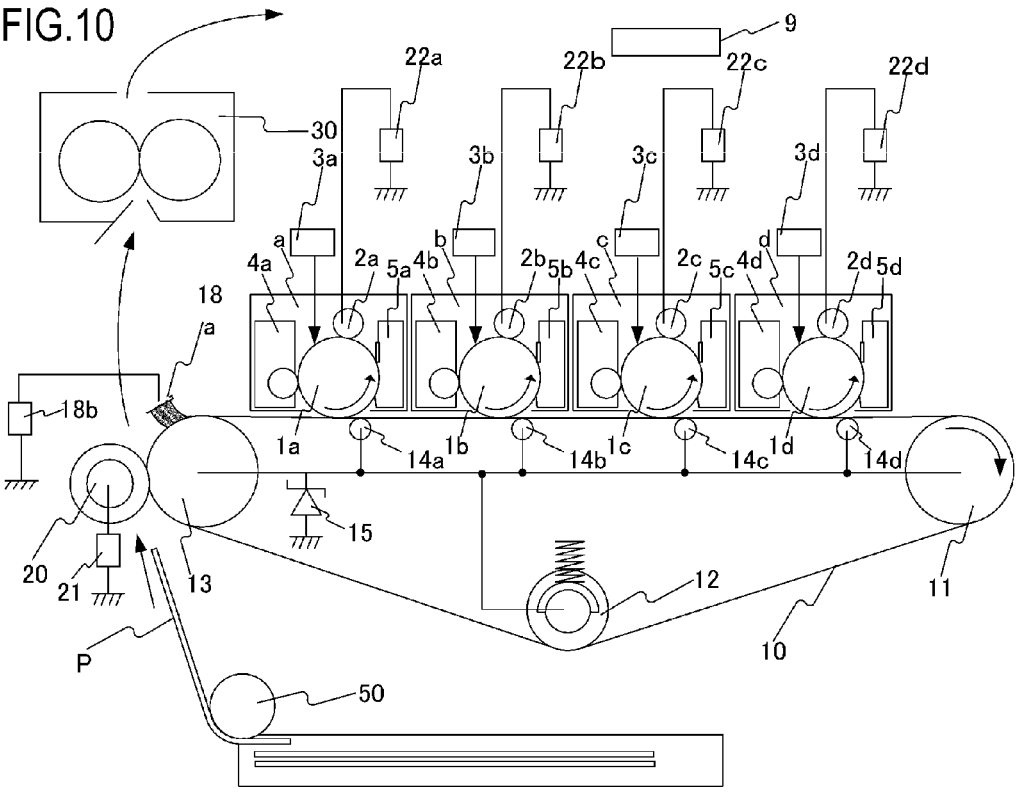
FIG. 10 is an explanatory drawing of another configuration example in Embodiment 2 of the present invention.
Figure 11:
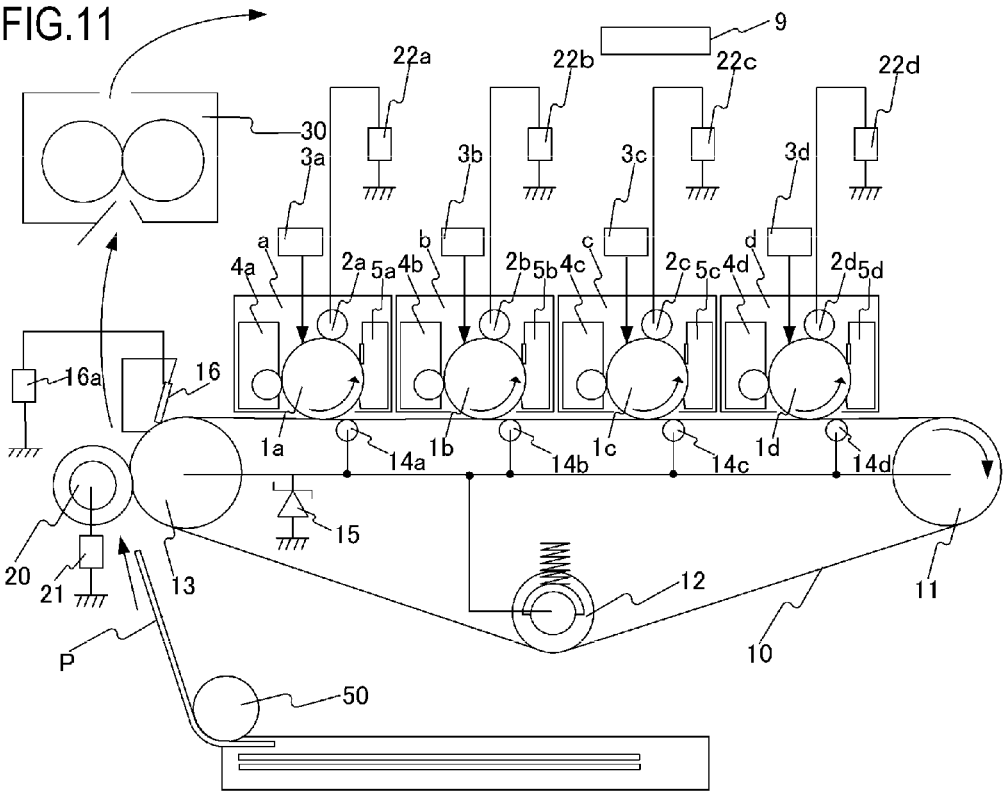
FIG. 11 is an explanatory drawing of another configuration example in Embodiment 2 of the present invention.

In the present embodiment, the configuration is explained in which the secondary transfer roller 13 is used as the current supply member, but such a configuration of the current supply member is not limiting. Thus, as depicted in FIG. 10, a power supply 18*b* may be connected to a conductive brush 18*a* having a function of cleaning the toner on the intermediate transfer belt 10, and the conductive brush 18*a* may be used as the second current supply member, in addition to the secondary transfer roller 13 (first current supply member). Further, as depicted in FIG. 11, as a result of connecting a cleaning power supply 16*a* to the cleaning device 16 depicted in Embodiment 1, the cleaning device 16 may be used as the second current supply member, in addition to the secondary transfer roller 13 (first current supply member). In those configurations, a current flowing in each primary transfer region is a superposition of the current flowing in the intermediate transfer belt 10 which is supplied by the secondary transfer roller 13 and the current flowing in the intermediate transfer belt 10 which is supplied by the second current supply member. The effect that can be obtained with those configurations is the same as in the present embodiment. Further, the conductive brush 18*a* and the cleaning device 16 may be configured to be used as a current supply member instead of the secondary transfer roller 13.

The features of the above-described embodiments can be combined with each other whenever possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-165260, filed Aug. 14, 2014, which is hereby incorporated by reference herein in its entirety.

What is claimed is:

1. An image forming apparatus comprising:

a first photosensitive body that bears a toner image;

a second photosensitive body that bears a toner image;

a movable endless intermediate transfer belt;

a secondary transfer member that forms, together with the intermediate transfer belt, a secondary transfer region, and secondary transfers a toner image from the intermediate transfer belt to a transfer member in the secondary transfer region, and that supplies an electric current to the intermediate transfer belt; and a control unit that can execute a first mode in which a first current amount is supplied from the secondary transfer member to the intermediate transfer belt and a toner image is primarily transferred from the first photosensitive body and the second photosensitive body to the intermediate transfer belt, and a second mode in which a second current amount which is less than the first current amount is supplied from the secondary transfer member to the intermediate transfer belt and the toner image is primarily transferred only from the first photosensitive body to the intermediate transfer belt, wherein the control unit can adjust surface potentials of the first photosensitive body and the second photosensitive body, and makes an absolute value of the surface potential of the second photosensitive body less than an absolute value of the surface potential of the first photosensitive body when the second mode is executed.

2. The image forming apparatus according to claim 1, further comprising:

a first charging member that charges the first photosensitive body; and a second charging member that charges the second photosensitive body, wherein the control unit controls a charging potential created by the first charging member and a charging potential created by the second charging member, and makes the charging potential created by the second charging member less than the charging potential created by the first charging member when the second mode is executed.

3. The image forming apparatus according to claim 2, further comprising:

a first charging power supply that applies a charging voltage to the first charging member; and a second charging power supply that applies a charging voltage to the second charging member, wherein the charging voltage applied by the second charging power supply is made less than the charging voltage applied by the first charging power supply when the second mode is executed.

4. The image forming apparatus according to claim 2, further comprising:

a first charging power supply that applies a charging voltage to the first charging member; and a second charging power supply that applies a charging voltage to the second charging member, wherein the second charging power supply stops applying the voltage to the second charging member when the second mode is executed.

5. The image forming apparatus according to claim 1, wherein the secondary transfer member is in contact with an outer circumferential surface of the intermediate transfer belt.

6. The image forming apparatus according to claim 1, further comprising a transfer power supply that applies a voltage to the secondary transfer member, wherein the transfer power supply is a power supply for primarily transferring a toner image from the first photosensitive body or the second photosensitive body to the intermediate transfer belt and for secondarily transferring the toner image from the intermediate transfer belt to the transfer member.

7. The image forming apparatus according to claim 1, wherein the first photosensitive body is disposed downstream of the second photosensitive body in the movement direction of the intermediate transfer belt.

8. The image forming apparatus according to claim 1, further comprising:

a tension member that tensions the intermediate transfer belt; and a voltage maintaining element that is connected to the tension member, wherein a transfer potential formed in a primary transfer region formed by the intermediate transfer belt and the first photosensitive body and/or the second photosensitive body is prevented from exceeding a predetermined potential by allowing part of the current supplied by the secondary transfer member to the intermediate transfer belt to flow to a ground side through the voltage maintaining element.

9. The image forming apparatus according to claim 8, further comprising a contact member that is in contact with an inner circumferential surface of the intermediate transfer belt and serves for bringing the first photosensitive body into contact with the intermediate transfer belt, wherein the voltage maintaining element is connected to the contact member.

10. The image forming apparatus according to claim 8, wherein the voltage maintaining element is a Zener diode.

11. The image forming apparatus according to claim 1, wherein the second photosensitive body is in contact with the intermediate transfer belt when the second mode is executed.

12. The image forming apparatus according to claim 1, further comprising an exposure unit that exposes the second photosensitive body, wherein the control unit performs constant exposure of the second photosensitive body with the exposure unit when the second mode is executed.

13. The image forming apparatus according to claim 1, further comprising a current supply member that is in contact with the intermediate transfer belt at a position different from the positions where the first photosensitive body and the second photosensitive body are in contact with the belt, and that supplies an electric current to the intermediate transfer belt.

14. The image forming apparatus according to claim 13, wherein the current supply member is a cleaning member that cleans a surface of the belt.

* * * * *